United States Patent [19]

Graebe

[11] Patent Number: 5,052,068

[45] Date of Patent: Oct. 1, 1991

[54] CONTOURED SEAT CUSHION

[76] Inventor: Robert H. Graebe, 7 Persimmon Bridge Dr., Belleville, Ill. 62221

[21] Appl. No.: 655,205

[22] Filed: Feb. 11, 1991

Related U.S. Application Data

[63] Continuation of Ser. No. 436,459, Nov. 14, 1989, abandoned.

[51] Int. Cl.[5] ..... A47C 7/02

[52] U.S. Cl. ..... 5/455; 5/464; 297/459; 297/DIG. 3

[58] Field of Search ..... 5/455, 464; 297/458, 297/459, DIG. 3

[56] References Cited

U.S. PATENT DOCUMENTS

| | | | |
|---|---|---|---|
| 2,099,870 | 11/1937 | Stanley | 5/455 |
| 2,199,047 | 4/1940 | Fisher | 5/455 |
| 3,296,635 | 1/1967 | O'Hanlan | 297/DIG. 3 |
| 3,982,786 | 9/1976 | Burgin | 5/455 |
| 4,445,240 | 5/1984 | Voorhees | 5/455 |
| 4,541,136 | 9/1975 | Graebe | 5/455 |
| 4,615,856 | 10/1986 | Silverman | 297/458 |
| 4,698,864 | 10/1987 | Graebe | 5/441 |
| 4,726,624 | 2/1988 | Jay | 297/459 |
| 4,753,480 | 6/1988 | Morell | 297/458 |

FOREIGN PATENT DOCUMENTS

| | | | |
|---|---|---|---|
| 379288 | 8/1932 | United Kingdom | 5/455 |
| 420292 | 11/1934 | United Kingdom | 5/455 |
| 481540 | 3/1938 | United Kingdom | 5/455 |
| 2052965 | 2/1981 | United Kingdom | 297/459 |

*Primary Examiner*—Gary L. Smith
*Assistant Examiner*—F. Saether
*Attorney, Agent, or Firm*—Gravely, Lieder & Woodruff

[57] ABSTRACT

A contoured cellular cushion has a base and flexible cells, which are inflatable, projecting upwardly from the base. The base is rectangular and the cells are arranged in front-to-rear and transverse rows upon it. Moreover, the cells are preferably organized into two zones—an outer zone and an inner zone—with the cells of each zone being interconnected amongst themselves, but not with the cells of the other zone. The outer zone includes long cells which lie along the sides of the base in side sections and also in an abductor section between the side sections near the front margin. The shorter cells of the inner zone occupy the remainder of the base and produce a depression between the side sections and behind the abductor section of the outer zone, and troughs on each side of the abductor section. When one sits upon the cushion, the side sections of the outer zone cradle the individual such that the boney protuberances of the buttocks rest on the short cells of the depression, while the thighs extend through the troughs, being spread slightly by the abductor section. The contour formed by the cells of varying length is ideally suited for seating. All of the cells may be in communication in a single zone.

5 Claims, 2 Drawing Sheets

FIG. 1.
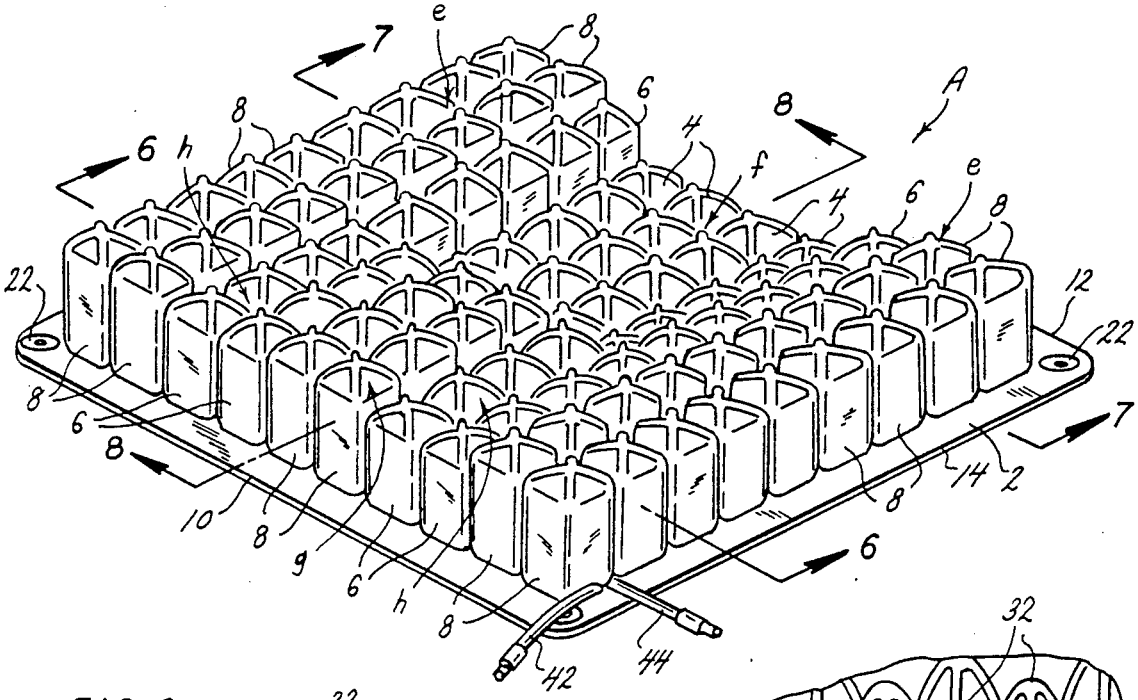
FIG. 3.
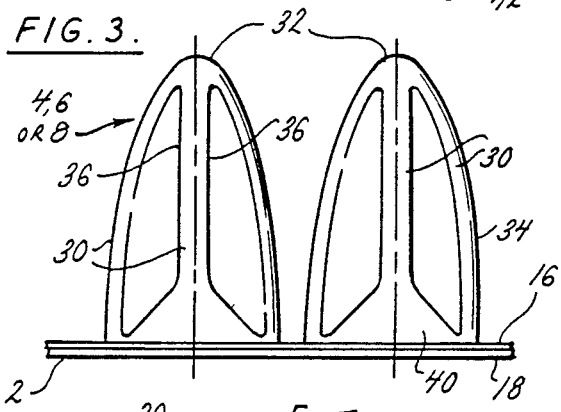
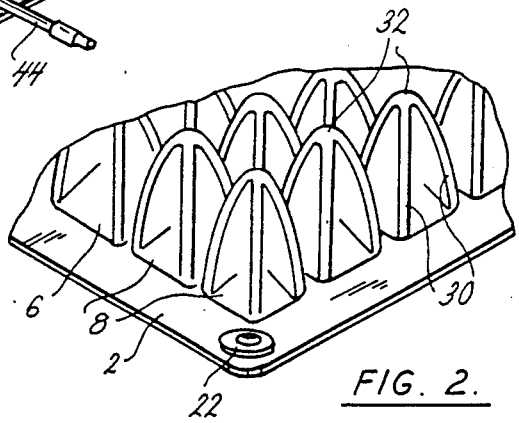
FIG. 2.
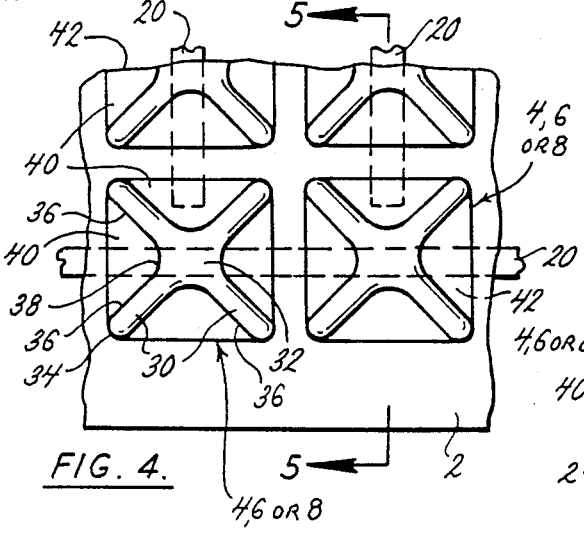
FIG. 4.
FIG. 5.
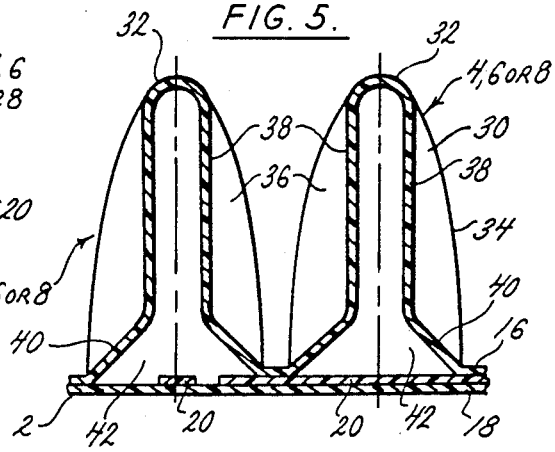

CONTOURED SEAT CUSHION

This is a continuation of copending application Ser. No. 07/436,459 filed on Nov. 14, 1989 now abandoned.

BACKGROUND OF THE INVENTION

This invention relates in general to cushions and more particularly to cellular cushions used for seating.

Those who are confined to seating surfaces for sustained periods of time run the risk of developing decubitus ulcers, more commonly known as bed sores, along the skin area that is presented toward or against the seating surface. The problem is particularly acute where the bony prominences of the pelvic bone, that is the ischia, protrude toward the seating surface. Of course, decubitus ulcers are less likely to develop over a soft surface, such as a cushion, than over a relatively hard surface such as a bench or sling type wheelchair seat. Even so, conventional cushions, such as those formed from expanded polymers, leave much to be desired and do not adequately accommodate those who are confined in a seated posture for extended periods of time.

With the introduction of the cellular cushion, a vast improvement occurred in the capacity to seat immobile individuals for extended periods of time without the development of decubitus ulcers. These cushions, which are sold under the trademark ROHO, have a multitude of flexible air cells which project upwardly from a common base, yet are otherwise detached from one another. The interiors of the cells, however, are in communication with each other through the base, and as a consequence the interiors of all the cells exist at the same pressure, irrespective of how little or how much the individual cells are deflected. Of course, when a person sits upon such a cushion, the cells will deflect to conform to that individuals body contour. Some of the cells will deflect more than others, and the cells beneath the bony prominences will perhaps deflect most of all. Nevertheless, the restoring or supporting force exerted by the cells is distributed over essentially the entire skin area that is in contact with the cushion, and that force, when considered per unit of area, remains essentially uniform. In other words, the cushion exerts a uniform pressure over the supported region of the body, which is normally the buttocks.

Despite their capacity to reduce the incidence of decubitus ulcers, cellular cushions may leave the occupant of such cushions feeling somewhat unstable.

U.S. Pat Nos. 4,005,236, 4,541,136 and 4,698,864 of R. H. Graebe disclose cellular cushions that are suitable for seating purpose, and when so used will reduce the incidence of decubitus ulcers substantially.

The present invention resides in a cellular cushion having cells of varying heights arranged such that they produce a supporting surface more in conformance with the shape of the occupants buttocks, yet slightly abducts the thighs. As a consequence, the cushion provides improved stability, greater comfort, and lessens still further the risk of bed sores developing.

DESCRIPTION OF THE DRAWINGS

In the accompanying drawings which form part of the specification and wherein like numerals and letters refer to like parts wherever they occur.

FIG. 1 is a perspective view of a cellular seat cushion constructed in accordance with and embodying the present invention, the cells of the cushion being inflated;

FIG. 2 is a perspective view of a corner of the cushion showing its cells deflated;

FIG. 3 is an elevational view of two deflated cells;

FIG. 4 is a plan view of several deflated cells;

FIG. 5 is a sectional view of two deflated cells taken along line 5—5 of FIG. 4;

DETAILED DESCRIPTION

Figure 7:
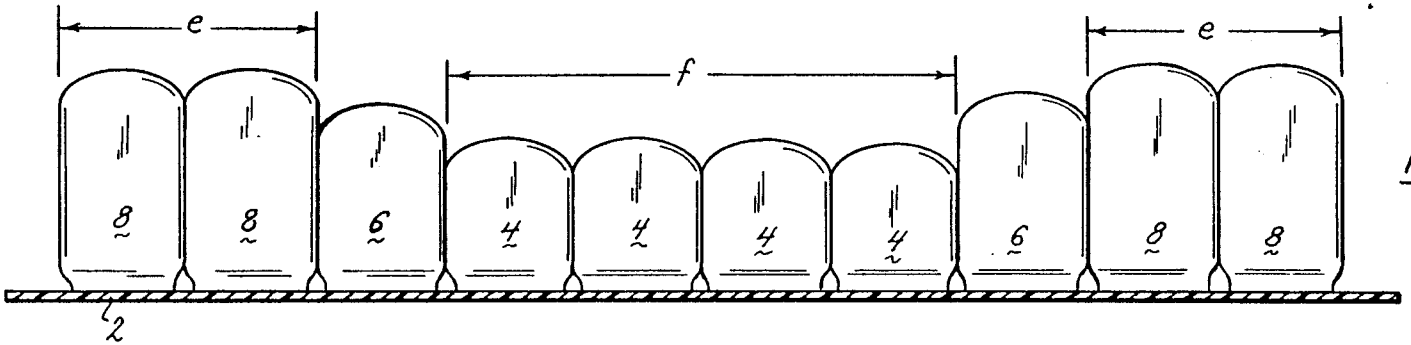
FIG. 7 is a sectional view of a cushion taken along line 7—7 of FIG. 1.

Referring now to the drawings, a cellular cushion A (FIG. 1) is suited for seating, particularly on relatively inflexible supporting surfaces such as the sling-type seat of a collapsible wheelchair or the hard seat of a typical chair. It basically includes a flexible base 2 which rests on and against the supporting surface, generally conforming to that surface, and short, intermediate and long cells 4, 6 and 8, respectively, which project upwardly from the base 2. The cells contain air which is entrapped in them, but no one cell 4, 6 and 8 is totally isolated. Indeed, the cells 4, 6 and 8 are organized into two pneumatic zones—that is an outer zone x and an inner zone y (FIGS. 1 and 9)—with the interiors of the cells 4, 6 and 8 of each zone x and y being in communication with each other, but not with the interiors of the cells 4, 6 and 8 of the other zone. The ends of the cells 4, 6 and 8 produce a generally continuous seating surface upon which the user sits.

The flexible base 2 possesses a rectangular configuration, and as such has a front margin 10, a rear margin 12 and parallel side margins 14 which extend between the front and rear margins 10 and 12 (FIG. 1). Moreover, the flexible base 2 is a laminate in that it has an upper layer 16 and a lower layer 18 (FIGS. 3 and 5), both of which are sheet-like and preferably formed from an elastomer such as neopreme. While the lower layer 18 is essentially continuous, the upper layer 16 is interrupted by the cells 4, 6 and 8 which are formed integral with it. Indeed, the interiors of the cells 4, 6 and 8 open downwardly through the upper layer 16. The two layers 16 and 18 are joined together with a suitable cement, and the seal so formed is continuous along the four margins 10, 12 and 14. The layers 16 and 18 are also bonded together intermediate the hollow interiors of the cells 4, 6 and 8, but these connections are for the most part interrupted so that the interiors of adjacent cells 4, 6 and 8 communicate. This is achieved with thin strips 20 (FIGS. 4 and 5) which pass between the two layers where they are aligned with and indeed exposed to the interiors of the cells 4, 6 and 8. By interrupting the bonds between the layers 16 and 18, the strips 20 provide passages through which air can flow between adjacent cells 4, 6 or 8. The strips 20, however, do not pass between the zones x and y. The layers 16 and 18 are likewise joined together along a continuous seal at the boundaries between the zones x and y. At each of its corners, the base 2 has metal grommet 22. The cells 4, 6 and 8, apart from their differences in height, are essentially identical. Preferably, they are formed in a dipping operation along with the upper layer 16 of the base 2. Each, being from an elastomer, is quite flexible and has a hollow interior which opens downwardly through the upper layer 16 of the base 2. Being highly flexible, the top of each cell 4, 6 and 8 possesses six degrees of freedom—that is,up and down, left and right, and forwardly and backwardly, as well as rotationally.

When deflated, each cell 4, 6 and 8 exhibits four fins 30 which rise from the base 2 to a dome 32 that is common to all of the fins 30 (FIGS. 2–5). Indeed, the fins 30 taper upwardly to the dome 32, presenting four gently curved edges 34 between the base 2 and the dome 32. Each fin 30 has a pair of side walls 36 which are closely spaced, yet parallel, and are joined by the curved edge 34 for the fin 30. The side walls 36 of adjacent fins 30 merge at concave connecting walls 38. Neither the side walls 36 nor the connecting walls 38 extend all the way to the upper layer 16 of the base 2, but instead connect with beveled walls 40 which are located between the fins 30 and are inclined upwardly from the periphery of the fin 30 toward the lower ends of the connecting walls 26. The four beveled walls 40 give the deflated cells 4, 6 and 8 a somewhat square stance and a pyramidal bottom that forms a square opening 42 in the upper layer 16 of the base 2.

When a cell 4, 6 or 8 is inflated, the side walls 36 of its fine 30 as well as the concave connecting walls 38 and the beveled walls 40 spread outwardly—indeed, somewhat beyond the square opening 42 at its bottom—and give the cell 4, 6 or 8 a somewhat bulbous appearance. Yet the cell 4, 6 or 8 retains its generally rectangular configuration, with its corners being formed by the gently curved edges 34 of the fins 30. The expansion is enough to enable the sides of adjacent cells 4, 6 and 8 to contact each other. Moreover, the domes 32 increase in area, acquiring additional surface area from the fins 30 and concave connecting walls 38. The domes 32 of the total array of cells 4, 6 and 8 produce a generally continuous surface that is capable of conforming to and supporting an irregularly shaped body such as the buttocks of a human being. U.S. Pat. No. 4,541,136 described the cells 4, 6 and 8 in more detail.

While cells 4, 6 and 8 having four fins and otherwise being of the configuration described and illustrated are perhaps best suited for the cushion A, cells of other cross-sectional configurations, such as square, hexagon, or circular, or cells having more or less fins, are likewise suitable.

Figure 9:
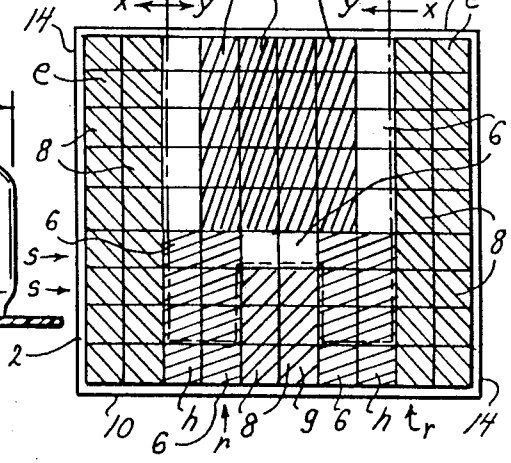
FIG. 9 is a schematic plan view of a cushion showing its zones and sections.
Figure 8:
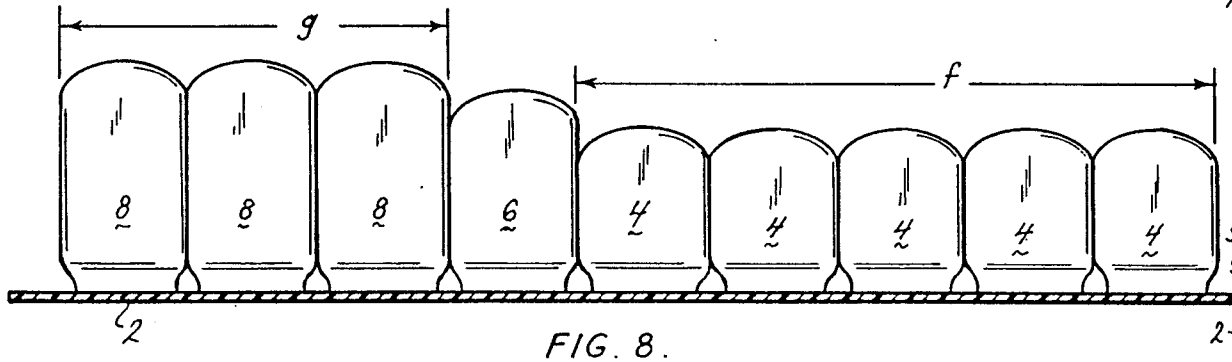
FIG. 8 if a sectional view of a cushion taken along line 8—8 of FIG. 1.

The cells 4, 6 and 8 are arranged in front-to-rear rows r that lie parallel to the side margins 14 of the base 2 and transverse rows s that extend parallel to the front and rear margins 10 and 12 (FIG. 9). A typical cushion A for a wheel chair has ten front-to-rear rows r and nine transverse rows s. The front-to-rear rows r that are located along the two side margins 14 of the base 2 contain only the long cells 8. The same holds true with regard to the rows r immediately inwardly from the two outer rows r, that is the second rows r in from the side margins 14. The two front-to-rear rows r of long cells 8 thus produce elevated side sections e along the side margins 14 of the base 2. The next or third row r in from each side margin 14 contains only intermediate cells 6. The two fourth rows r inwardly from the side margins 14 contain both intermediate cells 6 and short cells 4, with the former being closer to the front margin 10 and the latter closer to the rear margin 12. Typically, the fourth rowns inwardly from the side margins 14 have four intermediate cells 6 and five short cells 4, with the intermediate cells 6 being together toward the front margin 10 and the short cells 4 being together in the remainder of the row r. The two fifth rows r inwardly from the side margins 14, which are actually the two centermost rows r and as such lie adjacent to each other, each contains all three lengths of cells 4, 6 and 8, with the long cells 8 being concentrated toward the front margin 10, the short cells 4 being concentrated at the rear margin 12 and the intermediate cells 6 being in between (FIG. 8). Typically, each of the two centermost rows r has three long cells 8, one intermediate cell 6 and five short cells 4 arranged in that order from the front margin 10 to the rear margin 12. Thus, along its side margins 14 the cushion A has its greatest height, but midway between its side margins the cushion A steps downwardly from the front margin 10 to the rear margin 12.

The cells 4, 6 and 8 which form the front-to-rear rows r likewise form the transverse rows s (FIG. 9). The last transverse row s, which is located along rear margin 12, has two long cells 8 at each side, a single intermediate cell 6 located immediately inwardly from each of the pairs of two long cells 8, and four short cells 4 in the space between the two intermediate cells 6 (FIG. 7). The same holds true with regard to the next four transverse rows s. The next transverse row s has cells 6 between those long cells 8. The result is a depression f, the base of which is formed by the array of short cells 4. One side of the depression f simply opens rearwardly at the rear margin 12 of the base 2, but the three remaining sides are bordered by intermediate cells 6. Indeed, the intermediate cells 6 along the two sides of the depression f form a gentle transition from the short cells 4 to the long cells 8 of the two side sections e.

Figure 6:
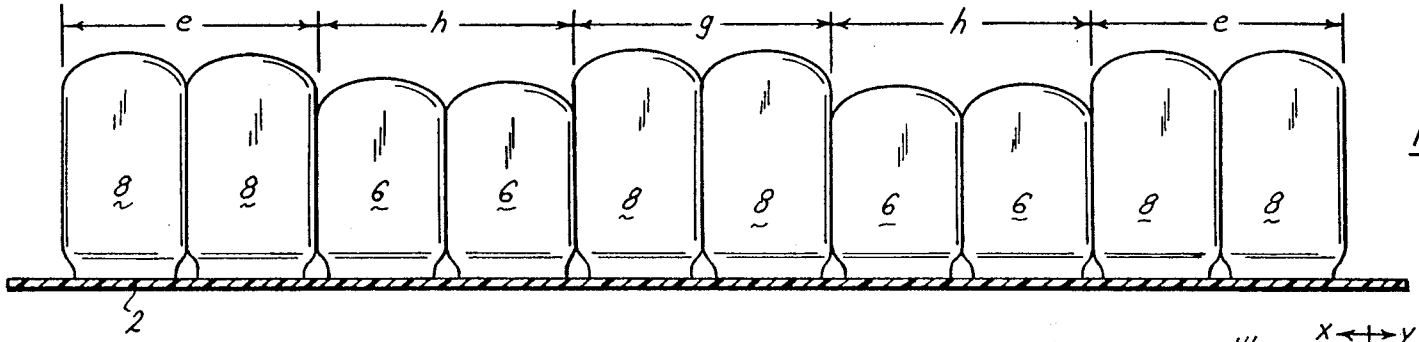
FIG. 6 is a sectional view of a cushion taken along line 6—6 of FIG. 1.

The transverse row s at the front margin 10 has two long cells 8 at each side, these being part of the two side sections e, two more long cells 8 at its center and intermediate cells 6 between the long cells 8 at the center and the long cells 8 of the side sections e (FIG. 6). The same holds true with regard to the next two rows, that is the two rows s that lie immediately inwardly from the front row s. The several long cells 8 that lie between the elevated side sections e provide an elevated abductor section g at the front of the cushion A in front of the depression f. The intervening intermediate cells 6, that is the cells 6 which lie between the abductor section g and the two side sections e, form the bases of two troughs h which extend forwardly from the depression f and open out of the cushion A above the front margin 10 of the base 2.

The outer zone x includes all of the long cells 8 as well as the intermediate cells 6 of the first transverse rows s, that is the cells 6 that lie at the very front of the trough h (FIGS. 1 and 9). Thus, the zone x lies along the two side margins 14, where it forms the elevated side sections e, as well along the front margin 10, and further includes the elevated abductor section g. In short, it lies along much of the periphery of the cushion A. The inner zone y occupies the remainder of the cushion A and for the most part lies inwardly from the outer zone x. The inner zone y includes all of the short cells 4 and most of the intermediate cells 6. The short cells 4 of the zone y produce the depression f at the rear of the cushion A, whereas some of the intermediate cells 6 lie along the sides and front of the depression f and produce a transition from the higher long cells 8 of the side section e and abductor section g to the short cells 4 of the depression f. More of the intermediate cells 6 lie on each side of the long cells 8 for the abductor section g, and these cells 6 create the two troughs h.

At one of the front corners of the base 2, the long cell 8 at that corner is provided with a stem 42 which is fited with a valve (FIG. 1). When the valve of the stem 42 is opened, air may be forced into the cells 4 and 8 that comprise the outer zone x. At this same location another stem 44 passes between long cells 8 of the outer zone x to the closest intermediate cell 6 of the inner zone y. The stem 44 likewise contains a valve. When this valve is open, air may be forced through the stem 44 into the cells 4 and 6 of the inner zone y to inflate those cells. Inflated cells 6 and 8 of the outer zone x, generally speaking, rise to a higher elevation than inflated cells 4 and 7 of the center zone y, because they are longer. The supporting surface formed by the domes 32 of the cells 4, 6 and 8 thus assumes a contour that is well suited for seating, that is to say it has the centered abductor section g at its font and troughs h between the abductor section g and the elevated side sections e, as well as the depression f between the side sections e immediately to the rear of the abductor section g. The stems 42 for the zones x and y may be located on other cells as well.

To use the cushion A for seating purposes, one inflates the cells 4, 6 and 8 of the two to a pressure somewhat greater than is required for comfortable seating, and then places the cushion A on a horizontal supporting surface, such as a chair seat, with the front margin 10 of the base 2 along the front margin of the supporting surface. This places the valve stems 42 and 44 forwardly where the valves in them can be easily manipulated. The user than sits upon or is placed upon the surface formed by the domes 32 at the upper ends of the cells 4, 6 and 8. The bony prominences of the buttocks will settle generally into the depression f formed at the rear of the cushion A by the short cells 4 of the inner zone y. The long cells 8 which form the side sections e in the outer zone x, in effect produce a cradle which tends to nestle the user's buttocks over the short cells 4 of the depression f in the inner zone y. The long cells 8 of the abductor section g at the center of the cushion A spread the users thighs somewhat, while the long cells 8 of the side sections e keep the thighs from spreading excessively. In short, the long cells 8 near the front margin cradle the user's legs over the intermediate cells 6 that form the trough h.

Once the user settles into the cushion A, he opens the valves in the two valve stems 42 and 44 to allow air to escape from the cells 4, 6 and 8. The user sinks further into the cushion A, and thus the user's weight is distributed over an even greater area of the buttocks. This not only improves tissue viability, but further enchances comfort. However, enough air should remain in each zone x and y to keep the domes 32 for cells 4, 6 and 8 of the zones x and y above the base 2, or in other words, no cell 4, 6 or 8 should bottom out against the base 2.

The user finds his primary support in the cells 4 and 6 of the inner zone y, particularly the cells 4 and 6 that form the depression f at the rear of the cushion A. Since these cells are interconnected, they all exist at the same internal pressure, and hence the supporting force per unit of skin area that is in contact with the inner zone y is uniform. This promotes tissue viability and thus reduces the incidence of bed sores for one who is confined to the cushion A for extended periods of time. The longer cells 8 of the outer zone x cradle the user's buttocks over the shorter cells 4 of the inner zone y and further position the thighs in a slightly abducted condition, but yet prevent them from spreading excessively. The user may, to a measure, transfer the supporting force between the zones x and y. For example, if the user desires to concentrate more of the support on the thighs, so that the skin area in the region of the bony prominences receives less force, the cells 6 and 8 of the outer zone are inflated to a greater extend than the cells 4 and 6 of the inner zone y.

While the pneumatic zones x and y are useful in the sense that they provide the user with some control over where the primary supporting force on the user's body will be applied, the cushion A may have its cells 4, 6 and 8 all in communication, that is organized in a single pneumatic zone. The contour formed by the cells 4, 6 and 8, arranged as they are, requires less immersion in the cushion to achieve a sense of stability on it. One acquires a sensation of stability even with overinflated cells 4, 6 and 8. On the other hand, more than two pneumatic zones are possible. For example, the two side sections e may each fall within a separate pneumatic zone, the abductor section g in another, and the depression f in still another. Other variations are possible.

While the cells 4, 6 and 8 exhibit four fins 30 when deflated, they may be formed with more fins, such as shown in U.S. Pat. No. 4,005,236. Or they may be mostly cylindrical and have no fins at all.

This invention is intended to cover all changes and modifications of the example of the invention herein chosen for purposes of the disclosure which do not constitute departures from the spirit and scope of the invention.

What is claimed is:

1. A cushion comprising: a base having front, rear and side margins, long cells projecting upwardly from the base along its side margins to form two spaced apart side sections to prevent the user's thighs from excessive spreading; more long cells projecting upwardly from the base near the front margin and between the side sections, yet spaced from the side sections, to form an abductor section to prevent inward rotation of the user's thighs; short cells located between the side sections and behind the abductor section to form a depression that extends to the rear margin to cradle the user's buttock; and intermediate cells, projecting upwardly from the base between the abductor section and the two side sections, the intermediate cells being shorter than the long cells to form troughs between the abductor section and the side sections, but being longer than the short cells; whereby the cushion possesses a contour that is well suited for seating, and the troughs cradle the user's legs, the short cells of the depression and at least some of the intermediate cells of the troughs adjacent to the abductor cells being in pneumatic communication through the base and pneumatically isolated from the long cells and the remainder of the intermediate cells to allow the long cell area and the short cell area to be inflated separately to provide the desired stability in the side and in the abductor areas and the desired cushioning in the depression and trough areas.

2. A cushion according to claim 1 wherein more intermediate cells project upwardly from the base between the short cells of the depression and the long cells of the side sections and abductor section to form a transition between the depression and the side and abductor sections.

3. A cushion comprising: a rectangular base formed from a flexible material and having front, side and rear margins; long flexible air cells projecting upwardly from the base along the side margins and being organized into side sections, each side section having at least one front-to-rear row of long cells that extend from the front margin to the rear margin to prevent the user's thighs from excessive spreading; more long air cells organized into at least two front-to-rear rows that are located between the side sections and further extend rearwardly from the front margin, but terminate ahead of the rear margin, to form an abductor section to prevent inward rotation of the user's thighs; short flexible air cells located behind the long air cells of the abductor section and between the long air cells of the side sections to form a depressed section along the rear margin to cradle the user's buttocks; intermediate air cells, which are longer than the short cells but shorter than the long air cells, located in at least one rearwardly extending row on each side of the abductor section so as to be between the long air cells of the abductor section and the long air cells of each side section to thereby form troughs that lead rearwardly to the depressed section to cradle the user's legs, the long air cells of the side sections and the long air cells of the abductor section being in pneumatic communication in one zone and the short air cells of the depressed section and at least some of the intermediate cells of the trough being in pneumatic communication in another zone; the two zones being pneumatically isolated from each other.

4. A cushion according to claim 3 wherein more intermediate cells are located in a single front-to-rear row between the long cells of each side section and the short cells of the depressed section so as to form a transition between the side sections and the depressed section, the said intermediate cells in said front-to-rear rows being in pneumatic communication with the long air cell zone.

5. A cushion according to claim 4 wherein still more intermediate cells are arranged in a lateral row between the long cells of the abductor section and the short cells of the depressed section to form a transition between the two sections, said intermediate cells in said lateral row being in pneumatic communication with the short air cell zone.

* * * * *